US005794460A

United States Patent [19]

Matsuda et al.

[11] Patent Number: 5,794,460

[45] Date of Patent: Aug. 18, 1998

[54] KNIT SLIDE FASTENER STRINGER

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 879,818

[22] Filed: Jun. 20, 1997

[30] Foreign Application Priority Data

Jun. 24, 1996 [JP] Japan ..... 8-163381

[51] Int. Cl.[6] ..... D04B 21/20; D04B 21/14; A44B 19/56

[52] U.S. Cl. ..... 66/193; 66/192; 66/190; 24/392

[58] Field of Search ..... 66/192, 193, 190; 24/392

[56] References Cited

U.S. PATENT DOCUMENTS

| | | | |
|---|---|---|---|
| 5,035,125 | 7/1991 | Frohlich et al. | 66/193 |
| 5,502,985 | 4/1996 | Matsuda et al. | 66/193 |
| 5,502,986 | 4/1996 | Matsuda et al. | 66/192 X |
| 5,522,240 | 6/1996 | Wall et al. | 66/192 |
| 5,540,064 | 7/1996 | Matsuda et al. | 66/193 |
| 5,615,563 | 4/1997 | Matsuda et al. | 66/192 X |
| 5,685,177 | 11/1997 | Matsuda et al. | 66/193 |
| 5,706,677 | 1/1998 | Matsuda | 66/192 |

FOREIGN PATENT DOCUMENTS

| | | |
|---|---|---|
| 0 743 025 A2 | 11/1996 | European Pat. Off. . |
| 38 011 673 A | 7/1963 | Japan . |
| 02 255 104 A | 10/1990 | Japan . |
| 08 000 314 A | 1/1996 | Japan . |

*Primary Examiner*—John J. Calvert
*Attorney, Agent, or Firm*—Hill & Simpson

[57] ABSTRACT

A knit slide fastener stringer comprising: a fastener tape knit in a warp-knit ground structure and having along one longitudinal edge an element-attaching marginal portion, and a continuous fastener element row knitted in and along the element-attaching marginal portion of the fastener tape and secured by anchoring chain stitch yarns of at least two wales simultaneously with the knitting of the fastener tape. In the slide fastener stringer, an additional anchoring chain stitch yarn independent from the anchoring chain stitch yarns is disposed between the anchoring chain stitch yarns near the coupling head portions and successive coupling head portions, extending warpwise over the fastener element row. And a connecting yarn extending weftwise substantially diagonally in gaps between adjacent fastener elements from the upper side to the lower side connects the additional anchoring chain stitch yarn with the ground structure of the fastener tape.

6 Claims, 8 Drawing Sheets

KNIT SLIDE FASTENER STRINGER

BACKGROUND OF THE INVENTION

1. Field of the Invention

This invention relates to a knit slide fastener stringer having a warp-knit fastener tape and a continuous fastener element row which is knitted in and along a longitudinal edge of the fastener tape simultaneously with the knitting of the fastener tape. More particularly the invention relates to a knit slide fastener stringer in which a continuous fastener element row is attached to one longitudinal edge of a warp-knit fastener tape stably without either causing irregularity in pitch or locally splitting from the fastener element row.

2. Description of the Related Art

A conventional knit slide fastener stringer of the type in which a continuous fastener element row is knitted in a fastener tape simultaneously with the knitting of the fastener tape is disclosed in, for example, Japanese Patent Publication No. Sho 38-11673 and Japanese Patent Laid-Open Publication No. Hei 2-255104. In either of these knit slide fastener stringers, a continuous fastener element row of a synthetic resin monofilament is attached to one longitudinal margin of a fastener tape, which has a warp-knit ground structure, by knitting the continuous fastener element row with stitches of a plurality of anchoring chain stitch yarns at the longitudinal tape margin to secure the element row, simultaneously with the knitting of the fastener tape. However, in the former knit slide fastener stringer, partly since each element of the continuous fastener element row is secured to the longitudinal margin of the fastener tape only by a single sinker loop of respective anchoring chain stitch yarn, and partly because of the natural stretchability of chain stitches, only a limited degree of securing force can be obtained. In the latter knit slide fastener stringer, since the sinker loops or the needle loops of the anchoring chain stitch yarns extend over the leg portions of the successive fastener elements, the ground structure of the element-attaching marginal tape portion becomes thin so that local split tends to occur at a coupled portion of a pair of coupled fastener element rows as it is raised when an upward bending stress acts on the slide fastener surface.

A knit slide fastener stringer developed in an effort to eliminate the foregoing problems is disclosed in, for example, Japanese Patent Laid-Open Publication No. Hei 8-314. According to this knit slide fastener stringer, in needle loops forming a single wale of the ground structure of a fastener tape by element-row-anchoring chain stitch yarns, another chain stitch yarn is additionally knitted in an effort to make the ground structure dense so that the fastener element row can be secured to the ground structure with increased stability.

However, even in the knit slide fastener stringer of Japanese Patent laid-Open Publication No. Hei 8-314, since knitting yarns to press the fastener element row downwardly on the side remote from the ground structure are yet only sinker loops of the anchoring chain stitch yarns, the knit structure to be disposed over and under the fastener element row become unbalanced and the one over the fastener element row would be still inadequately tough so that the coupled fastener element rows would tend to split locally when an upward bending stress acts on the slide fastener surface. Further, in order to stabilize the anchoring chain stitches themselves, an additional chain stitch yarn is knitted in the ground structure as disclosed in the publication, which means that total three knitting yarns including a tricot stitch yarn are interlaced, thus it is technologically complex and hence is difficult to form stitches.

SUMMARY OF THE INVENTION

It is therefore an object of this invention to provide a knit slide fastener stringer in which a fastener element row can be knitted easily and secured to a warp-knit fastener tape firmly in a stable size by a unique warp-knit structure and has an adequate degree of resistance against an upward thrust acting on the slide fastener surface so that no local split would tend to occur between coupled fastener element rows even when the slide fastener is bent while using.

According to this invention, the above object is accomplished by a knit slide fastener stringer comprising: a fastener tape knit in a warp-knit ground structure and having along one longitudinal edge an element-attaching marginal portion, and a continuous fastener element row knitted in and along the element-attaching marginal portion of the fastener tape and secured by anchoring chain stitch yarns of at least two wales simultaneously with the knitting of the fastener tape. In the slide fastener stringer, a number of additional anchoring knitting yarns are disposed between the anchoring chain stitch yarns and successive coupling head portions of the fastener element row and extending warpwise over the fastener element row, and the anchoring knitting yarns and the ground structure of the tape are connected by a part of the knitting extending weftwise substantially diagonally in gaps between adjacent fastener elements of the fastener element row from the upper side to the lower side to connect the anchoring knitting yarns with the ground structure of the fastener tape.

Specifically, the anchoring knitting yarn is knit to have chain stitches, and the part of knitting yarns is a further independent connecting yarn interlaced with chain stitches of the anchoring knitting stitch yarn and the ground structure of the fastener tape to connect the chain stitches and the ground structure together. Alternatively, the part of the knitting yarns is consisted of a part of the anchoring knitting yarns, part of which extending weftwise substantially diagonally in gaps of adjacent fastener elements of the fastener element row from the upper side to the lower side and being interlaced with the ground structure and the other part of which are disposed only on the upper side of the fastener element row.

Additionally, it is preferable that one or more warp-inlaid yarns are laid in each of the two or more wales of the anchoring chain stitch yarns, or are laid in and extend in a zigzag pattern between the two or more wales of the anchoring chain stitch yarns. In the latter case, it is preferable that the warp-inlaid yarns extend individually in a zigzag pattern and collectively in a symmetrical pattern, repeatedly crossing one another. In this invention, "a part of knitting yarns" may mean some of the plurality of knitting yarns, or alternatively, it may mean portions of one or more knitting yarns.

With this arrangement, since the fastener element row is firmly secured as being pulled at the upper side of the fastener elements near the coupling head portions toward the ground structure, by the additional knitting yarns independent of the ordinary anchoring yarns of chain stitches, it is possible to make the individual fastener elements stable in shape so that the coupled head portions are prevented from locally splitting when an upward thrusting stress acts on the slide fastener tape.

DETAILED DESCRIPTION OF THE PREFERRED EMBODIMENTS

Various preferred embodiments of this invention will now be described in detail with reference to the accompanying drawings.

In a knit slide fastener stringer according to this invention in which a fastener element row is knitted in an element-attaching marginal portion of a fastener tape having a warp-knit ground structure, simultaneously with the knitting of the fastener tape, by sinker loops or needle loops of two or more anchoring chain stitch yarns pressing upper and lower leg portions of successive fastener elements of the fastener element row toward the ground structure from the upper side. And it is characterized in that a number of additional anchoring knitting yarns are disposed between the anchoring chain stitch yarns and successive coupling head portions and extend warpwise over the fastener element row and are connected with and secured to the ground structure by another independent knitting yarn or part of the additional anchoring knitting yarns, which extends weftwise substantially diagonally in gaps of adjacent fastener elements from the upper side to the lower side.

Though a number of warp-inlaid yarns may be laid in the two or more wales of the anchoring chain stitch yarns, due to the simple knit structure, all stitches of the simple knit structure of the knit slide fastener stringer can be knitted simply by an ordinary warp-knitting machine equipped with a single row of needle beds. Also since the number of knitting yarns to be knitted on a single knitting needle is limited to a minimum, it is possible to realize smooth knitting of the slide fastener stringer without giving the knitting needles an excessive load.

Figure 1:
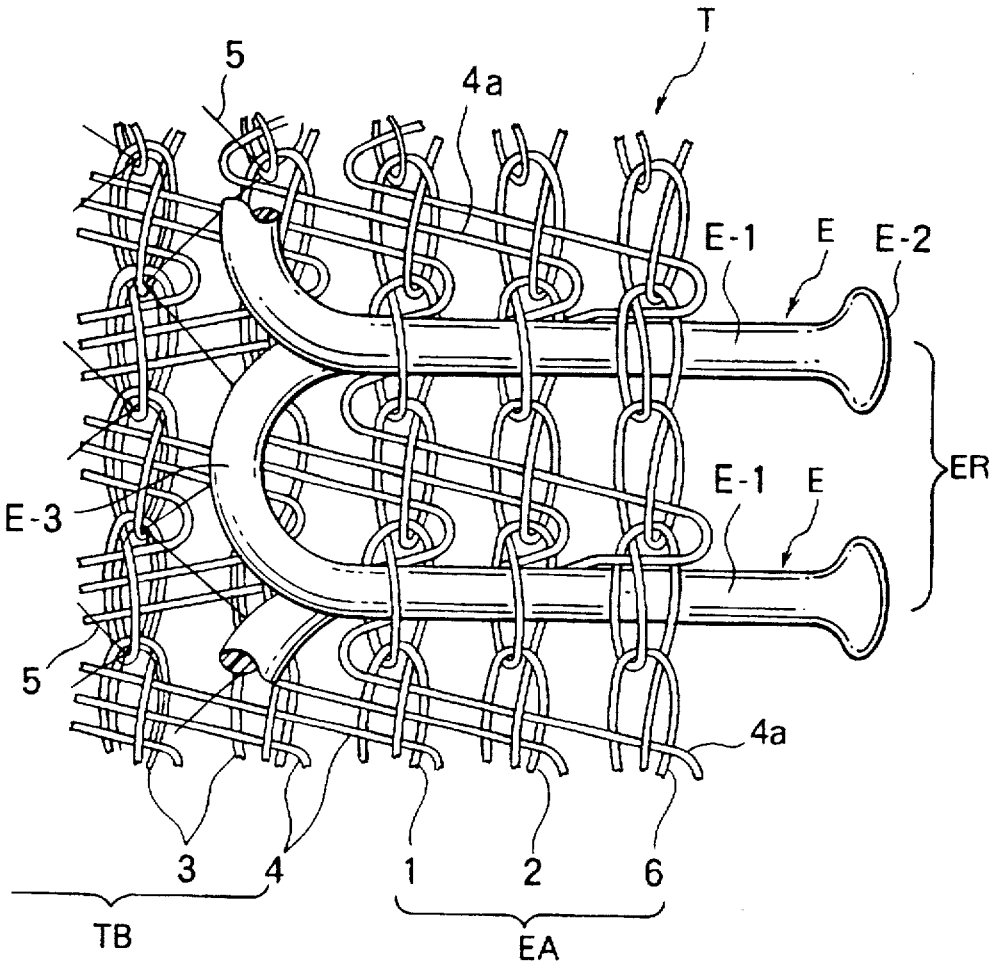
FIG. 1 is a fragmentary top plan view schematically showing an element-attaching marginal portion of a knit slide fastener stringer according to a first embodiment of this invention.
Figure 2:
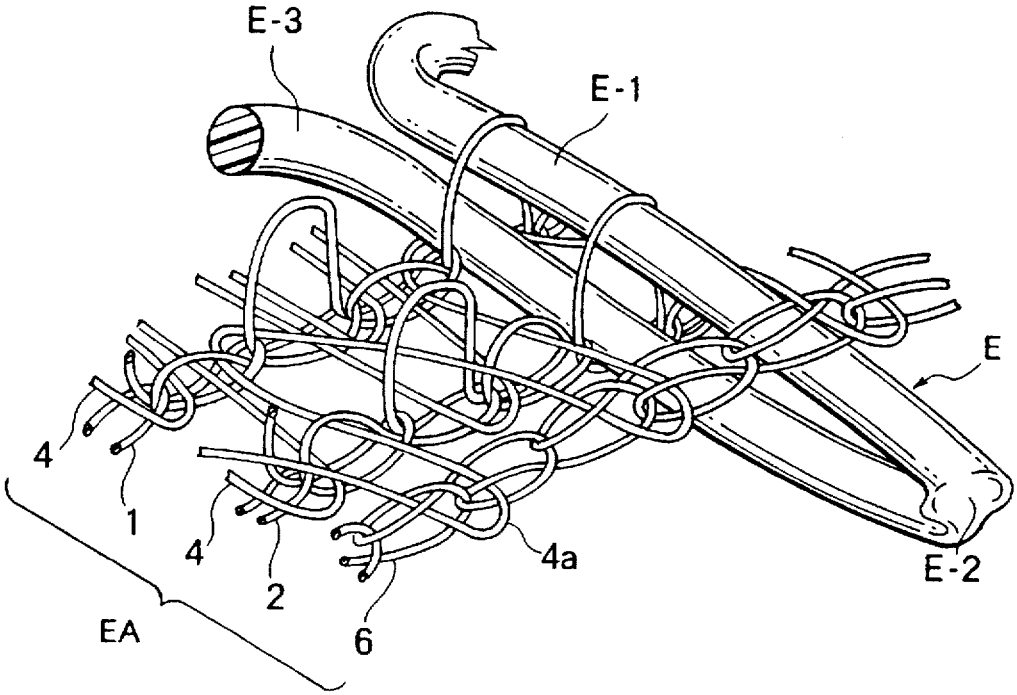
FIG. 2 is a perspective view, with parts broken away, of the element-attaching marginal portion of the first embodiment.
Figure 3:
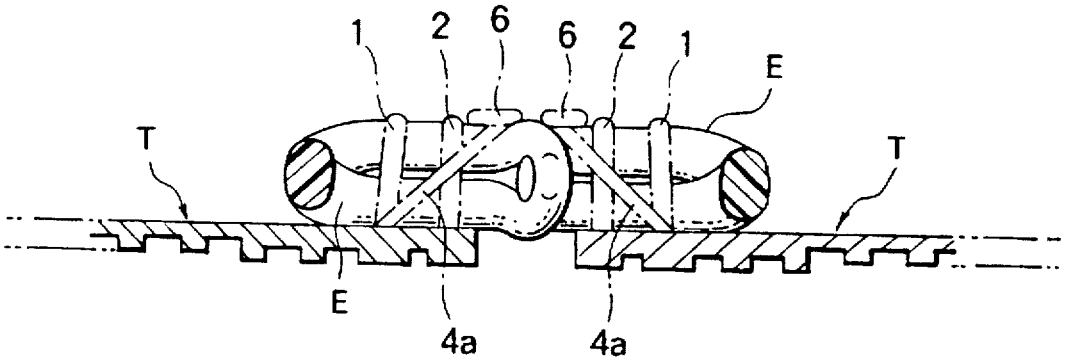
FIG. 3 is a fragmentary transverse cross-sectional view of a slide fastener using a pair of the knit fastener stringers of the first embodiment, showing the manner in which a pair of fastener element rows is secured to the respective element-marginal portions.

FIGS. 1 through 3 show a first embodiment of this invention; specifically, FIG. 1 is a fragmentary top plan view schematically showing an element-attaching marginal portion of a knit slide fastener stringer, FIG. 2 is a perspective view of the element-attaching marginal portion, and FIG. 3 is a fragmentary transverse cross-sectional view of a slide fastener using a pair of the knit fastener stringers of the first embodiment, showing the manner in which a pair of coupled fastener element rows is attached to the respective element-attaching marginal portions.

FIG. 1 concentrates on the element-attaching marginal portion EA of the fastener tape T while most of the remaining part, i.e. a web portion TB, has an ordinary well-known warp-knit structure composed of chain stitch yarns 3, weft-inlaid yarns 4, and tricot stitch yarns 5 in an arbitrary combination, so the detailed description is omitted here. Though in the accompanying drawings the individual knitting yarns of the element-attaching marginal portion of the fastener tape are shown in slacked state for better understanding, actually they have dense stitches and are tightly interlaced and/or interlooped with one another. Generally, various sized of knitting yarns are used and though the individual knitting yarns are shown quite differently in size for better understanding of the knitting structure, the various sizes of knitting yarns may be selected as desired being different from the illustrated example, considering function as the knit slide fastener.

In the first embodiment, the element-attaching marginal portion EA along one longitudinal outer edge of the fastener tape T comprises two wales of first and second anchoring chain stitch yarns 1, 2 constituting ordinary warp-knit chain stitches, one wale of third chain stitch yarn 6 disposed outside of the anchoring chain stitch yarns 1, 2 and constituting part of anchoring knitting yarns, and weft-inlaid yarns 4 laid in and extending between the three wales of the chain stitch yarns 1, 2, 6 in a zigzag pattern. In this and following embodiments, the weft-inlaid yarns 4 serve as connecting yarns. In the web portion TB other than the element-attaching marginal portion EA, chain stitch yarns 3, weft-inlaid yarns 4 and tricot stitch yarns 5, other than the outermost chain stitch yarn 6 constituting part of the anchoring knitting yarns are knitted.

Simultaneously with the knitting of the fastener tape T, a coiled synthetic resin monofilament is knitted in the element-attaching marginal portion EA, taking a return trip weftwise in every other courses to form a continuous fastener element row ER. In general, the fastener element row ER is secured to the element-attaching marginal portion EA by part of stitches of two or more wales of the anchoring chain stitch yarns 1, 2, which presses the upper and lower leg portions E-1. Whereas in this embodiment, each of the anchoring chain stitch yarns 1, 2 has successive sinker loops extending over the fastener element row ER, i.e., over the individual upper leg portions E-1 to interlace with successive needle loops disposed on the side of the ground structure of the element-attaching marginal portion EA, thus securing the fastener element row ER to the element-attaching marginal portion EA.

As a characteristic feature of this invention, the above-mentioned third chain yarn 6, which is independent of the first-named anchoring chain stitch yarns 1, 2 forming two wales, is disposed between the anchoring chain stitch yarns 1, 2 and the successive coupling head portions E-2 of the fastener element row ER. In this embodiment, the third anchoring chain stitch yarn 6 has successive stitches merely extending warp-wise over the upper leg portions E-1 of the fastener element row ER without being directly connected with the ground structure of the element-attaching marginal portion ER. This connection between the third chain stitch yarn 6 and the ground structure of the element-attaching marginal portion EA is realized by a weft-inlaid yarn 4*a*, among a large number of weft-inlaid yarns 4, which is disposed outermost in the element-attaching marginal portion EA. Accordingly, in this embodiment, the outermost weft-inlaid yarn 4*a* serves as a connecting yarn between the third anchoring knitting yarn 6 and the ground structure of the element-attaching marginal portion EA.

In the illustrated example, the connecting weft-inlaid yarn 4*a* is interlaced with the sinker loops of the third or outermost anchoring chain stitch yarn 6 at two courses to turn, then extend through the sinker loops of the second anchoring chain stitch yarn 2 being intermediate, which press the fastener element row ER from the upper side on the element-attaching marginal portion EA, then is interlaced with the sinker loops of the first or innermost anchoring chain stitch yarn 1 at two courses, which is disposed on the side toward the web portion TB, to turn over again, whereupon the weft-inlaid yarn 4*a* repeats the same to form a zigzag knitting pattern. At that time, as is understood from FIGS. 1, 2 and 3, the weft-inlaid yarn 4*a* firmly pulls the third anchoring chain stitch yarn 6 diagonally toward the ground structure with assistance of the sinker loops of the first anchoring chain stitch yarn 1 at two courses which loops do not press the leg portions E-1 of the fastener elements.

In short, the weft-inlaid yarn 4a as the connecting yarn is interlaced with the third anchoring chain stitch yarn 6 on the upper side of the fastener element row ER, then extends diagonally downwardly in the gap between adjacent elements of the fastener element row ER and is interlaced with the ground structure on the lower side of the connecting portion E-3 of the fastener element row ER, thus connecting the third anchoring chain stitch yarn 6 and the ground structure so as to attach the fastener element row ER tight. With this arrangement, the weft-inlaid yarn 4*a* as the connecting yarn can be laid firmly while the third chain stitch yarn 6 as the anchoring knitting yarn can be firmly held on the upper side of the fastener element row ER near the individual coupling head portions E-2. In this embodiment, the two chain stitch yarns 1, 2 are used as the original anchoring chain stitch yarns; alternatively, three parallel anchoring chain stitch yarns may be used to meet the length of the leg portions of the fastener element row ER.

Figure 4:
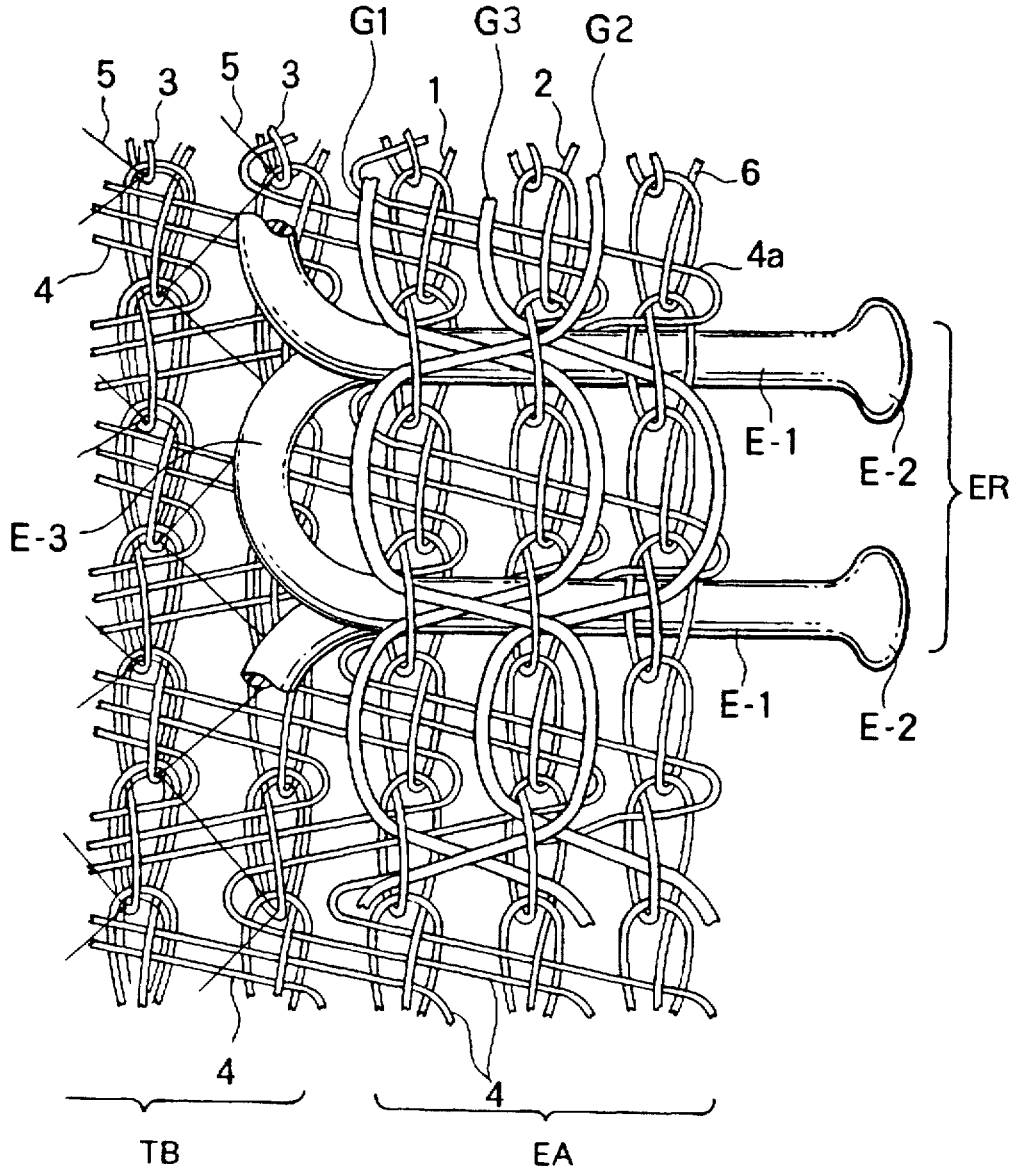
FIG. 4 is a fragmentary top plan view schematically showing an element-attaching marginal portion of a knit slide fastener stringer according to a second embodiment of the invention.
Figure 5:
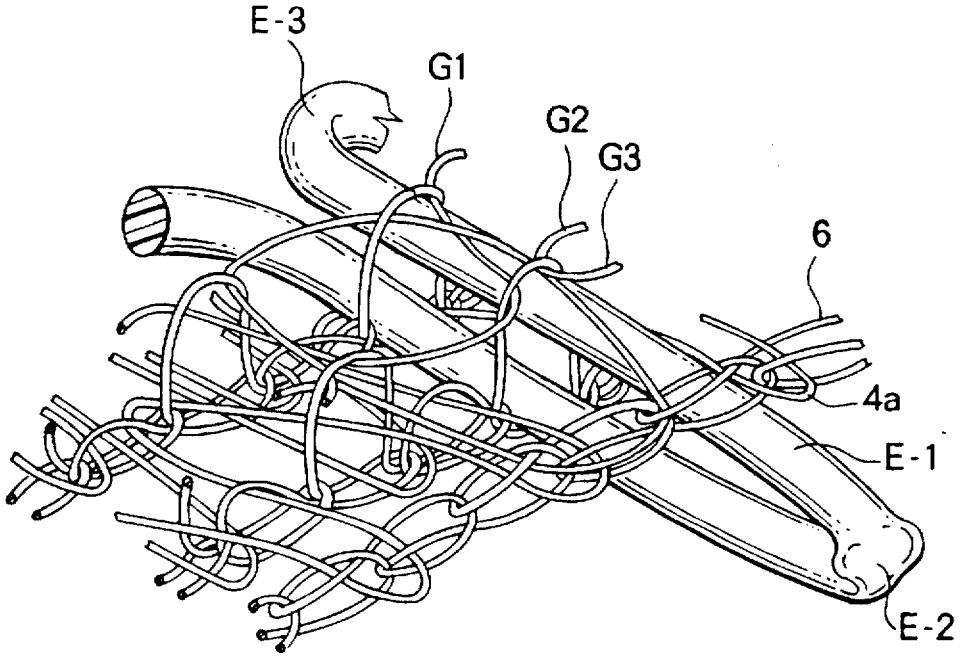
FIG. 5 is a perspective view, with parts broken away, of the element-attaching marginal portion of the second embodiment.
Figure 6:
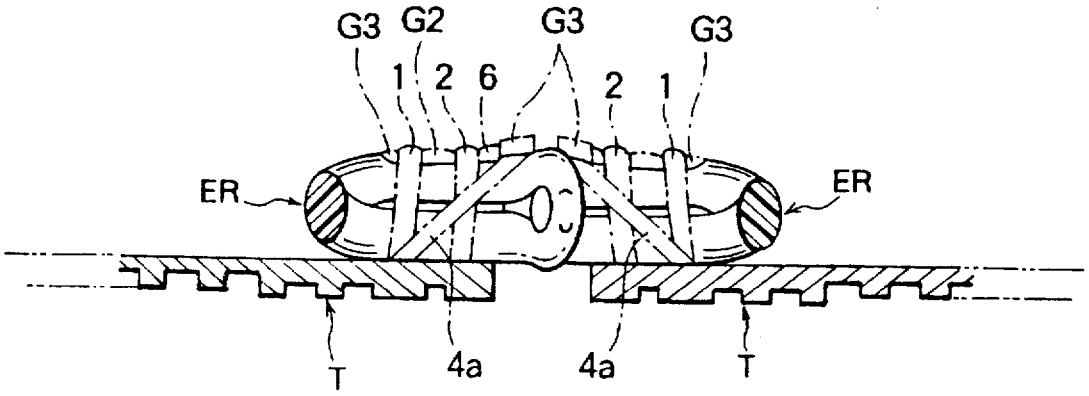
FIG. 6 is a fragmentary transverse cross-sectional view of a slide fastener using a pair of the knit fastener stringers of the second embodiment, showing the manner in which a pair of fastener element rows is secured to the respective element-attaching marginal portions.

FIGS. 4 through 6 shows a second embodiment. Also in this embodiment, the knit structure of the individual knitting yarns is identical with that of the first embodiment except the manner that three warp-inlaid yarns G1, G2, G3 are laid in the element-attaching marginal portion EA. Specifically, the two warp-inlaid yarns G1, G2 are inlaid in and interlaced with every other sinker loops of two wales of the first and second anchoring chain stitch yarns 1, 2, which secures the fastener element row ER in the form of a coiled synthetic resin monofilament, warpwise individually in a zigzag pattern and collectively in a symmetrical pattern, repeatedly crossing each other as illustrated between the two wales over the fastener element row ER.

Additionally, the third warp-inlaid yarn G3 is laid in and interlaced with every other sinker loops of the outermost anchoring chain stitch yarn 6 and every other sinker loops of the intermediate second anchoring chain stitch yarn 2 warpwise in a zigzag pattern, repeatedly crossing the second warp-inlaid yarn G2 to share a symmetrical pattern with it as illustrated over the fastener element row ER.

Since the sinker loops of the individual anchoring chain stitch yarns 1, 2, 6 are connected as being tightened by the three warp-inlaid yarns G1, G2, G3, it is possible to prevent the sinker loops from being displaced transversely of the fastener tape T so that the upper surface of the fastener element row ER can be covered relatively widely, thus realizing firm attachment of the fastener element row ER and an increased degree of resistance against heat and pressure while ironing.

Figure 7:
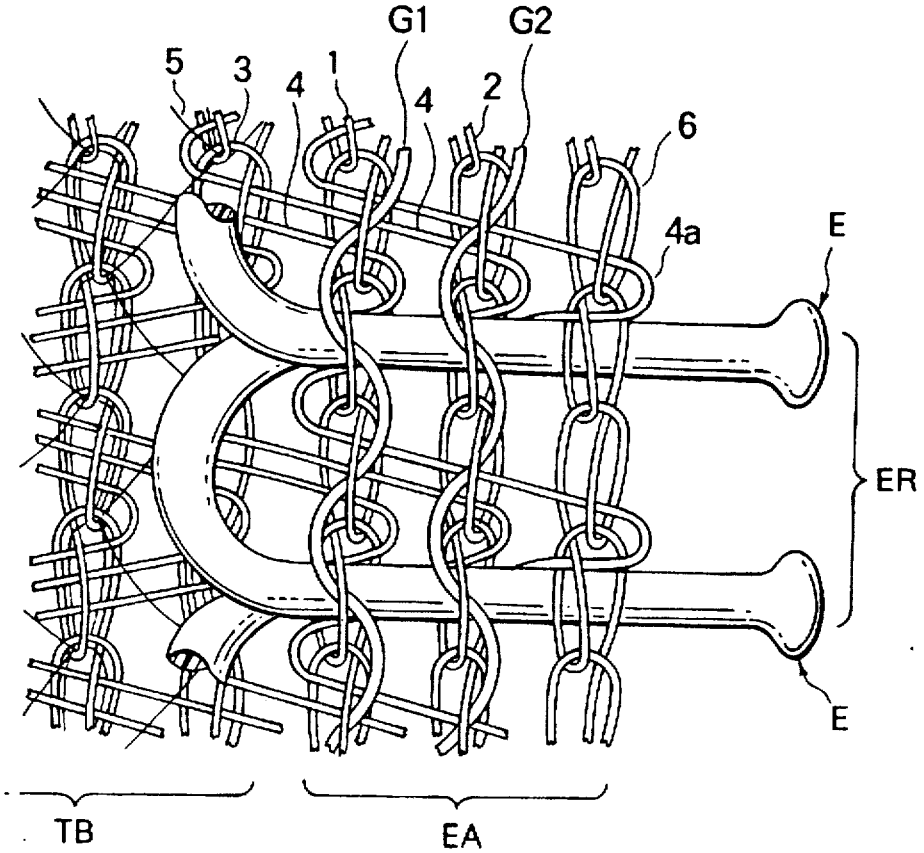
FIG. 7 is a fragmentary top plan view schematically showing an element-attaching marginal portion of a knit slide fastener stringer according to a third embodiment.

FIG. 7 shows a third embodiment, in which the knit structure of the individual knitting yarns are identical with that of the first embodiment except the manner that two warp-inlaid yarns G1, G2 are laid in the element-attaching marginal portion EA warpwise. Specifically, each of the two warp-inlaid yarns G1, G2 is laid in and interlaced successively with the individual sinker loops of each of the first and second anchoring chain stitch yarns 1, 2, extending over the fastener element row ER to be knitted integrally therein. In this illustrated example, no warp-inlaid yarn is laid in the stitches of the third anchoring chain stitch yarn 6, which is knitted in the element-attaching marginal portion EA to form the outermost wale over the fastener element row ER; alternatively, such warp-inlaid yarn may be laid in the third anchoring chain stitch yarn 6 as the case demands.

Figure 8:
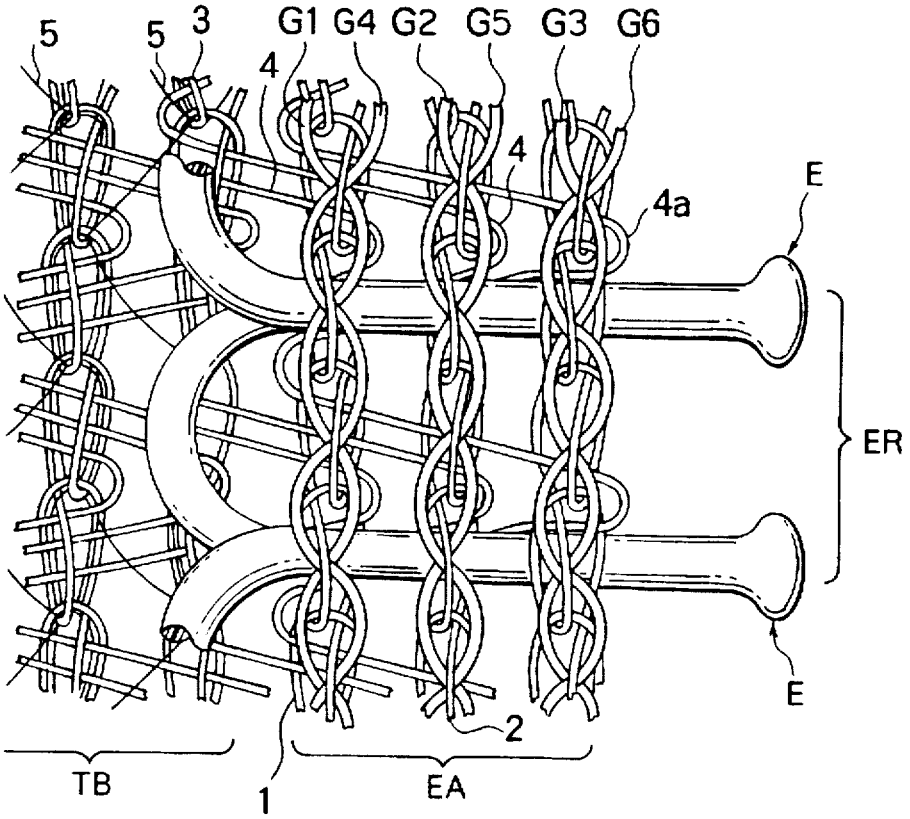
FIG. 8 is a fragmentary top plan view schematically showing an element-attaching marginal portion of a knit slide fastener stringer according to a fourth embodiment.

FIG. 8 shows a fourth embodiment, in which the knit structure of the individual knitting yarns of the web portion TB and the element-attaching marginal portion EA is identical with that of the first embodiment except for six warp-inlaid yarns G1–G6. Specifically, pairs of warp-inlaid yarns G1, G4; G2, G5; G3, G6 is inlaid and interlaced successively with the individual sinker loops of each of the first, second and third anchoring chain stitch yarns 1, 2, 6, which jointly secure the fastener element row ER in the form of a coiled synthetic resin monofilament, individually in a zigzag pattern and collectively in a symmetrical pattern, repeatedly crossing each other.

Figure 9:
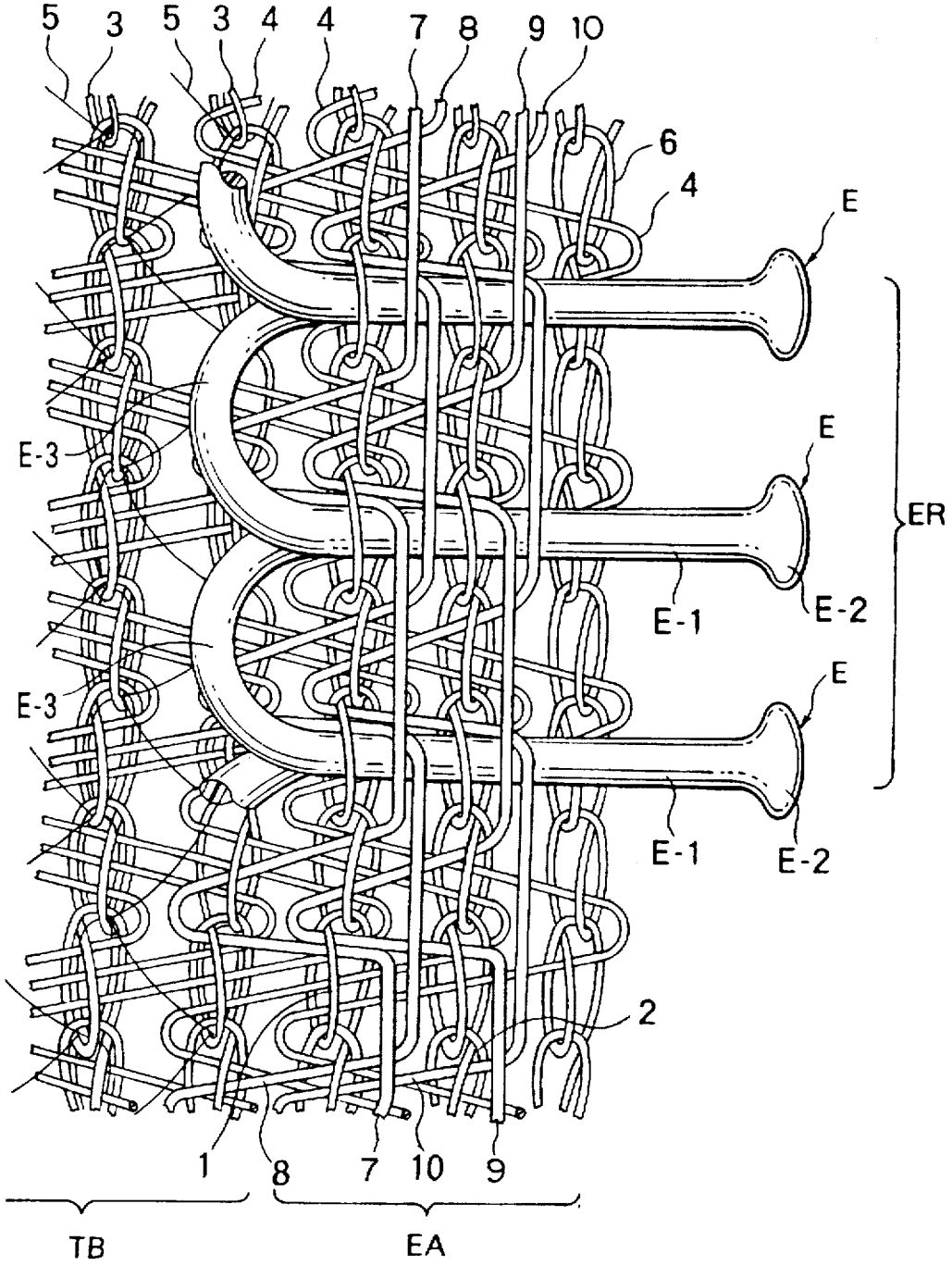
FIG. 9 is a fragmentary top plan view schematically showing an element-attaching marginal portion of a knit slide fastener stringer according to a fifth embodiment.
Figure 10:
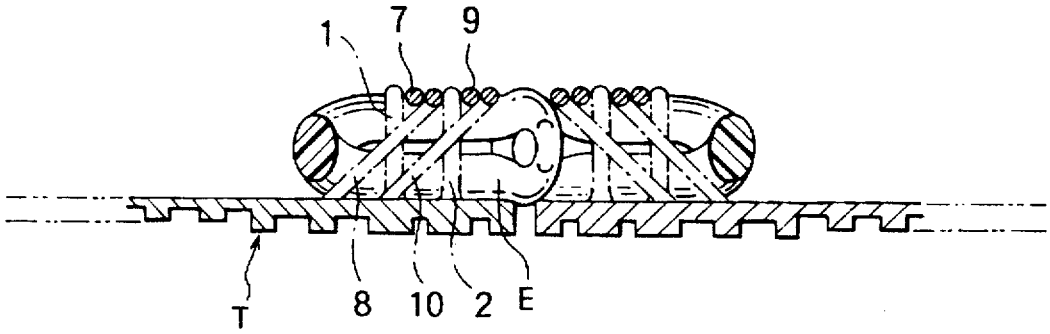
FIG. 10 is a fragmentary transverse cross-sectional view of a slide fastener using a pair of the knit fastener stringers of the fifth embodiment, showing the manner in which a pair of fastener element rows is secured to the respective element-attaching marginal portions.

FIGS. 9 and 10 show a fifth embodiment, in which the third anchoring chain stitch yarn 6 is knitted in the ground structure of the element-attaching marginal portion EA as the outermost wale extending under the fastener element row ER. In this embodiment, the anchoring knitting yarns are four warp-inlaid yarns 7–10 laid in the element-attaching marginal portion EA warpwise over the fastener element row ER as shown in FIG. 9.

Of the four warp-inlaid yarns 7–10, two warp-inlaid yarns 7, 8 have sections arranged between the wales of the first and second anchoring chain stitch yarns 1, 2, while the other two warp-inlaid yarns 9, 10 have sections arranged between the second anchoring chain stitch yarn 2 and the individual coupling head portions E-2 of the fastener element row ER. Each of the four warp-inlaid yarns 7–10 extends over the upper leg portions E-1 of two adjacent fastener elements E along the wale, then extends substantially diagonally downwardly away from the coupling head portions E-2 in the gap between the upper leg portions E-1, and is then interlaced with the chain stitch yarn 3, which is the outermost wale of the ground structure next to the first anchoring chain stitch yarn 1, whereupon each warp-inlaid yarn 7–10 turns diagonally upwardly to the upper side of the upper leg portion E-1 of the fastener element E and is then interlaced with every third sinker loops of the corresponding wale of the first or second anchoring chain stitch yarns 1, 2. As each warp-inlaid yarn 7–10 repeats this pattern, the individual upper leg portions E-1 of the next two adjacent fastener element E are pressed toward the ground structure by the warp-inlaid yarns 7–10 successively, to be held onto the upper surface toward the coupling heads E-2.

Since the individual fastener elements E are pressed against the element-attaching marginal portion EA as tightened by the joint action of the sinker loops of the anchoring chain stitch yarns 1, 2 and the four warp-inlaid yarns 7–10, the fastener element row ER can be secured to the element-attaching marginal portion EA firmly in a stabilized shape.

In the foregoing embodiments, the two chain stitch yarns 1, 2 are used as the original anchoring chain stitch yarns; alternatively, three parallel anchoring chain stitch yarns may be used to meet the length of the leg portions of the fastener element row ER. Also in this alternative case, the anchoring knitting yarns of this invention are disposed between the outermost anchoring chain stitch yarn and the coupling head portions. Also, the continuous faster element row should by no means be limited to a coiled type and may be of a zigzag or meandering type having successive U shapes, each of which constitutes upper leg portions of an adjacent coupling elements and a turnover portion connecting the upper or lower leg portions together in a plane parallel to the general plane of the fastener tape T and which are arranged alternately on the upper and lower sides of the individual coupling head portions along the entire length of the fastener element row.

Furthermore, this invention may be also applied to a concealed slide fastener stringer, in which firstly a continuous fastener element ER in the form of a coiled or meandering synthetic resin monofilament is attached to an element-attaching marginal portion of a fastener tape with coupling head portions disposed on the inner side remotely from the outer edge of the marginal portion and with turnover portions disposed on the outer side near the outer edge of the marginal portion and then the resulting stringer is attached to a garment with the marginal portion folded in such a manner that the coupling heads face to the outer side for mating with those of a companion slide fastener stringer.

As is apparent from the foregoing description, according to the knit slide fastener stringer of this invention, partly since a plurality of anchoring chain stitch yarns 1, 2 extend in parallel over the fastener element row ER secured onto the ground structure of the warp-knit fastener tape toward its coupling head portions E-2, and partly since the anchoring chain stitch yarns 1, 2 are firmly connected by another anchoring knitting yarn 4*a*, 7–10 having successive sections each extending diagonally in gaps of adjacent fastener elements to pull the anchoring chain stitch yarn 1, 2 from the upper side of the individual fastener element ER near the coupling head portion E-2 toward the ground structure near the connecting portion E-3, it is possible to attach the fastener element row ER firmly and stably by the plurality of parallel anchoring chain stitch yarns 1, 2 and the anchoring chain stitch yarns 1, 2 near the coupling head portions E-2 of the fastener elements are pulled toward the ground structure to be fixed firmly without staggering along its entire width. With this arrangement, in the slide fastener of this invention, the coupled fastener element rows can be prevented from locally splitting when an upward thrusting bending stress acts on the slide fastener surface while using, thus the slide fastener can perform its function stably.

Further, since the additional anchoring chain stitch yarn 6 disposed near the coupling head portions E-2 on the upper side of the fastener element row ER is fixed as being connected by the yarn 4a extending substantially diagonally to the lower side of the fastener element row ER away from the coupling head portions E-2, there exists no obstacle in the gap between adjacent coupling head portions E-2 even though knitting yarns are disposed over the fastener element especially near the coupling head portions so that smooth coupling and uncoupling action of the coupling head portions of the fastener element row can be coupled with those of a companion fastener element row smoothly.

What is claimed is:

1. A knit slide fastener stringer comprising:

(a) a fastener tape knit in a warp-knit ground structure and having along one longitudinal edge an element-attaching marginal portion;

(b) a continuous fastener element row knitted in and along said element-attaching marginal portion of said fastener tape and secured by anchoring chain stitch yarns of at least two wales simultaneously with the knitting of said fastener tape; and (c) a number of additional anchoring knitting yarns disposed between said anchoring chain stitch yarns and successive coupling head portions of said fastener element row and extending warpwise over said fastener element row, part of said anchoring knitting yarns and the ground structure of the tape being connected by a part of the knitting yarns extending weftwise substantially diagonally in gaps between adjacent fastener elements of said fastener element row from the upper side to the lower side to connect said anchoring knitting yarns with said ground structure of said fastener tape.

2. A knit slide fastener stringer according to claim 1, wherein said anchoring knitting yarn is knit to have chain stitches, and said part of knitting yarns is a further independent connecting yarn interlaced with chain stitches of said anchoring knitting yarn and said ground structure of said fastener tape to connect said chain stitches and said ground structure together.

3. A knit slide fastener stringer according to claim 1, wherein said part of said knitting yarns is consisted of a part of said anchoring knitting yarns, part of which extending weftwise substantially diagonally in gaps of adjacent fastener elements of said fastener element row from the upper side to the lower side and being interlaced with said ground structure and the other part of which are disposed only on the upper side of said fastener element row.

4. A knit slide fastener stringer according to claim 1, 2 or 3, further comprising one or more warp-inlaid yarns laid in each of said two or more wales of said anchoring chain stitch yarns.

5. A knit slide fastener stringer according to claim 1, 2 or 3, further comprising one or more warp-inlaid yarns laid in and extending in a zigzag pattern between said two or more wales of said anchoring chain stitch yarns.

6. A knit slide fastener stringer according to claim 4 or 5, wherein said warp-inlaid yarns extend individually in a zigzag pattern and collectively in a symmetrical pattern, repeatedly crossing one another.

* * * * *